US006663232B2

(12) United States Patent
Kondo et al.

(10) Patent No.: US 6,663,232 B2
(45) Date of Patent: Dec. 16, 2003

(54) CONFIGURATION OF INK JET PRINT HEAD CAPABLE OF RELIABLY MAINTAINING ITS CONTINUITY

(75) Inventors: Norimasa Kondo, Hitachinaka (JP); Yasuo Takano, Hitachinaka (JP)

(73) Assignee: Hitachi Printing Solutions, Ltd., kanagawa-ken (JP)

( * ) Notice: Subject to any disclaimer, the term of this patent is extended or adjusted under 35 U.S.C. 154(b) by 98 days.

(21) Appl. No.: 10/095,478

(22) Filed: Mar. 13, 2002

(65) Prior Publication Data

US 2002/0130928 A1 Sep. 19, 2002

(30) Foreign Application Priority Data

Mar. 16, 2001 (JP) ..... P2001-075178

(51) Int. Cl.[7] ..... B41J 2/045
(52) U.S. Cl. ..... 347/71
(58) Field of Search ..... 347/68–72

(56) References Cited

U.S. PATENT DOCUMENTS 4,516,140 A * 5/1985 Durkee et al. ..... 347/71
6,053,602 A * 4/2000 Noto et al. ..... 347/70
6,186,612 B1 * 2/2001 Maeda et al. ..... 347/17
6,457,222 B1 * 10/2002 Torii et al. ..... 347/68

* cited by examiner

*Primary Examiner*—Judy Nguyen
(74) *Attorney, Agent, or Firm*—Whitham, Curtis & Christofferson, P.C.

(57) ABSTRACT

An ink jet print head 1 includes a laminated piezoelectric element 31. The piezoelectric element 31 is fixedly attached to electrodes 33 by electrically conductive adhesive 32. A flexible printed cable 16 is electrically connected to electrodes 35 by soldering. The stationary plate 15 is formed with through holes 36, which are filled with an electrically conductive filler 34. The filler 34 and the electrodes 33, 35 are formed of tungsten, and the electrodes 33, 35 are plated with gold.

7 Claims, 3 Drawing Sheets

CONFIGURATION OF INK JET PRINT HEAD CAPABLE OF RELIABLY MAINTAINING ITS CONTINUITY

BACKGROUND OF THE INVENTION

1. Field of the Invention

The present invention relates to an ink jet print head, and more specifically to a continuity configuration of a laminated piezoelectric element of the head.

2. Related Art

A conventional ink jet print head includes a ceramic plate serving as a stationary plate, individual front electrodes mounted on a front surface of the ceramic plate, laminated piezoelectric elements electrically connected to the corresponding front electrodes by an electrically conductive adhesive, individual rear electrodes mounted on a rear surface of the ceramic plate, and flexible printed cable (FPC) electrically connected to the corresponding rear electrodes by soldering. The ceramic plate is formed from alumina with a plurality of through holes having a diameter of 0.25 mm. The through holes are filled with silver paste as filler, which electrically connecting the front electrode with the corresponding rear electrode. That is, the laminated piezoelectric element is electrically connected to the flexible printed cable via the front and rear electrodes and the filler.

This type of ink jet print head is formed in the following process. A green sheet is prepared and subject to calcinations to provide the ceramic plate. The plurality of through holes are formed in the ceramic plate by laser beam technique. The silver paste is applied into the through holes and also over the entire front surface of the ceramic plate, and is subject to sintering. The electrically conductive adhesive is coated over the front surface, and a block of piezoelectric element is placed thereon. The resultant product is subject to a dicing process to cut the block into the plurality of piezoelectric elements. At the same time, the silver paste on the ceramic sheet is also cut into a plurality of pieces, thereby providing the plurality of individual front electrodes.

However, the conventional ceramic plate with the above configuration has the following problems.

Firstly, when the above ceramic plate is placed in a high-temperature high-humid environment or get wet with ink, migration occurs in the front and rear electrodes. This results in continuity failure.

Secondly, a heat cycle that repeats between a room temperature and a higher temperature of 130° C. weakens the strength of the solder joint between the flexible printed cable and the rear electrodes, thereby causing disconnection.

SUMMARY OF THE INVENTION

It is an objective of the present invention to overcome the above problems and also to provide an ink jet print head in which continuity failure is effectively prevented and a method for producing the same.

In order to achieve the above and other objects, there is provided an ink jet print head including a stationary plate having a first surface and a second surface, a first electrode provided on the first surface, and a laminated piezoelectric element mounted on the first surface. The laminated piezoelectric element is electrically connected to the first electrode via an electrically conductive adhesive. The first electrode is formed of one of tungsten and molybdenum-manganese alloy.

There is also provided a producing method of producing an ink jet print head. The method includes the steps of a) forming a plurality of through holes in a green sheet, the through holes having first ends opened to a first surface of the green sheet and second ends opened to a second surface of the green sheet, b) filling in the through holes with filler, wherein the filler is one of tungsten and molybdenum-manganese alloy, c) forming a plurality of first electrodes from one of tungsten and molybdenum-manganese alloy on the first ends, d) forming a plurality of second electrodes from one of tungsten and molybdenum-manganese alloy on the second ends, e) plating the first and second electrodes with gold, f) placing a laminated-piezoelectric block on the first surface, g) applying an electrically conductive adhesive over the first surface and the first electrodes, and h) dicing the laminated-piezoelectric block into a plurality of laminated piezoelectric elements.

BRIEF DESCRIPTION OF THE DRAWINGS

In the drawings:

FIG. 3(*b*) is a plan view of the stationary plate in a manufacturing process of the head, where piezoelectric-element blocks are placed on the stationary plate;

FIG. 3(*c*) is a plan view of the stationary plate in the manufacturing process of the head, where an electrically conductive adhesive is coated over the stationary plate; and FIG. 3(*d*) is a plan view of the stationary plate after a dicing process is performed to cut the piezoelectric-element blocks into a plurality of piezoelectric elements in the manufacturing process of the head.

PREFERRED EMBODIMENT OF THE PRESENT INVENTION

Next, an ink jet print head 1 according to an embodiment of the present invention will be described while referring to the attached drawings.

Figure 1:
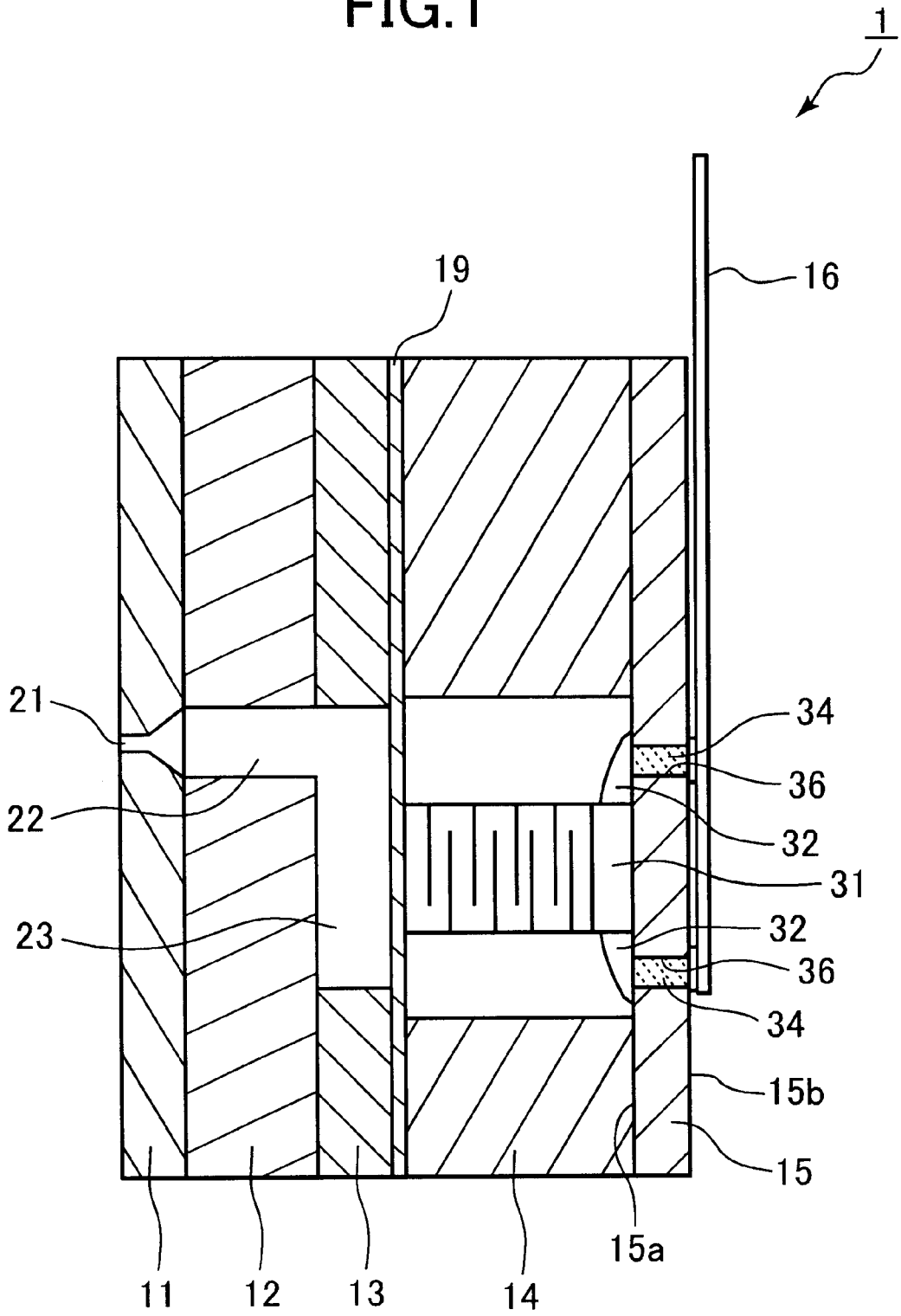
FIG. 1 is a cross-sectional view of an ink jet print head according to an embodiment of the present invention.

As shown in FIG. 1, an ink jet print head 1 of the present embodiment includes an orifice plate 11, a chamber plate 12, a restrictor plate 13, a diaphragm plate 19, a support plate 14, and a stationary ceramic plate 15. All are attached one on the other in this order to form a print head unit. The stationary plate 15 is formed from alumina (A1203) with high rigidity.

The orifice plate 11 is formed with an orifice 21, and the chamber plate 12 is formed with an ink chamber 22. The restrictor plate 13 is formed with a pressure chamber 23. The orifice 21, the ink chamber 22, and the pressure chamber 23 together define a nozzle.

The ink jet print head 1 further includes a laminated piezoelectric element 31 and a flexible printed cable 16. One end of the piezoelectric element 31 is attached to the diaphragm plate 19, and the other end is fixedly attached to a front surface 15*a* of the stationary plate 15 by epoxy adhesive (not shown). The flexible printed cable 16 is provided to a rear surface 15*b* of the stationary plate 15 for transmitting electrical signal to the piezoelectric element 31. The stationary plate 15 is formed with through holes 36, which are filled with an electrically conductive filler 34.

Figure 2:
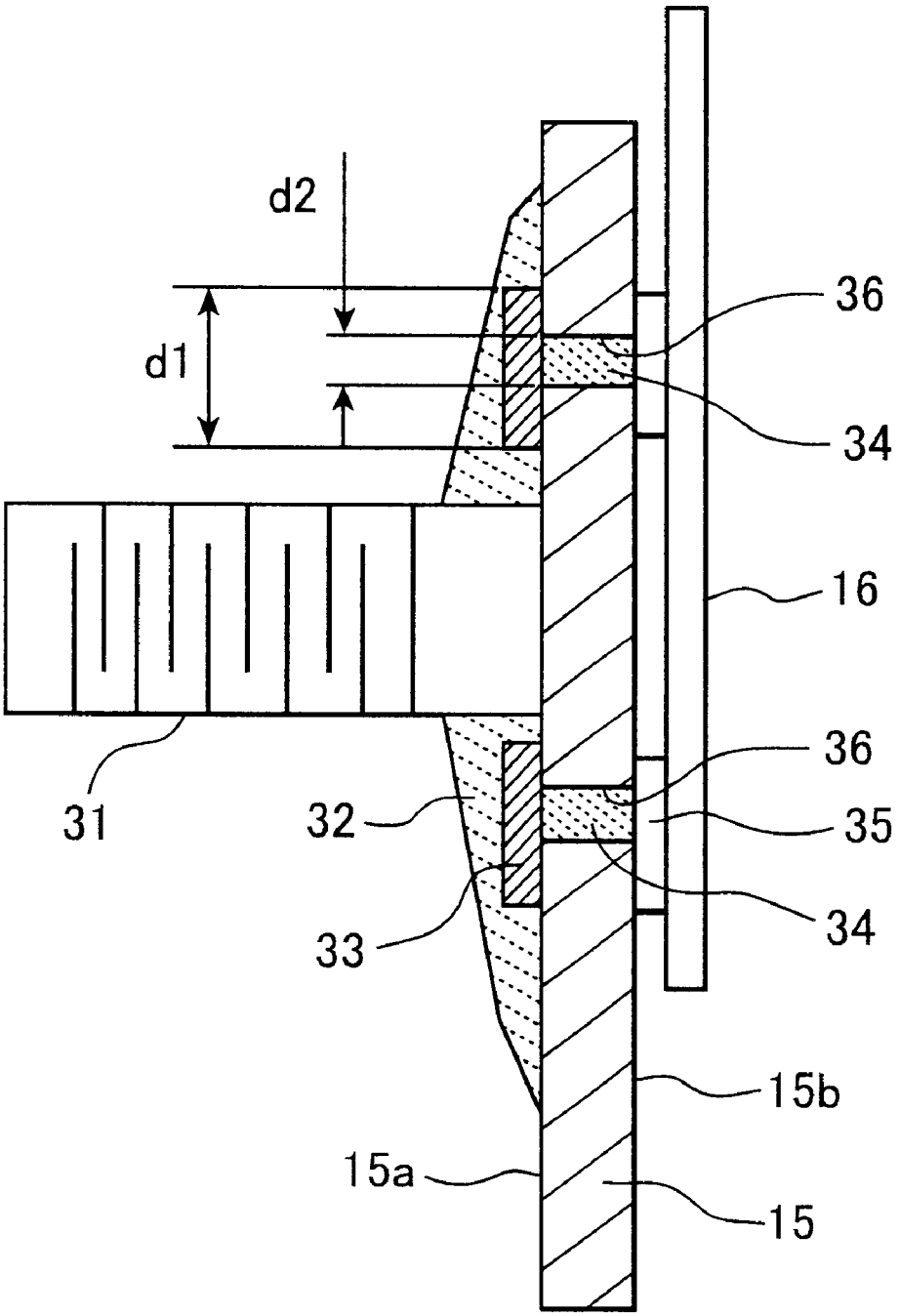
FIG. 2 is an enlarged partial view of FIG. 1.
Figure 3A:
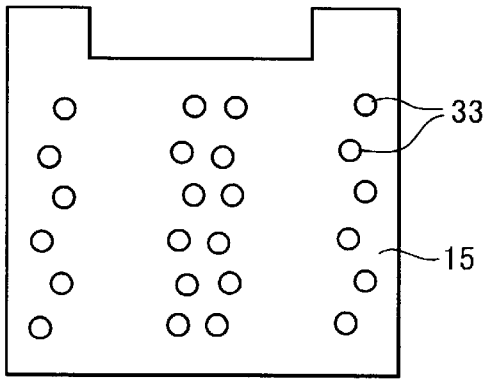
FIG. 3(*a*) is a plan view of a stationary plate with electrodes formed thereon in a manufacturing process of the head.
Figure 3B:
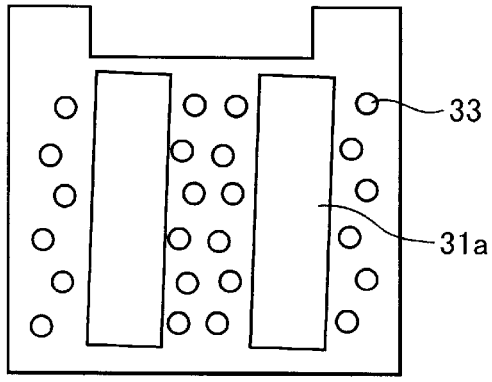
Figure 3C:
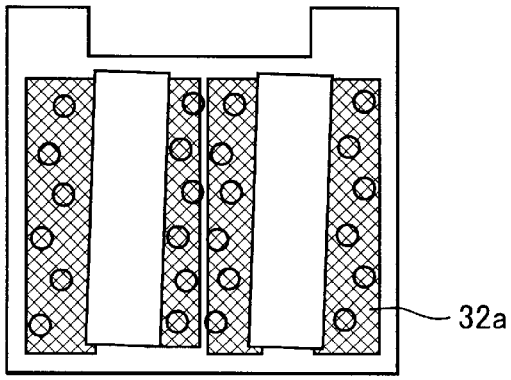
Figure 3D:
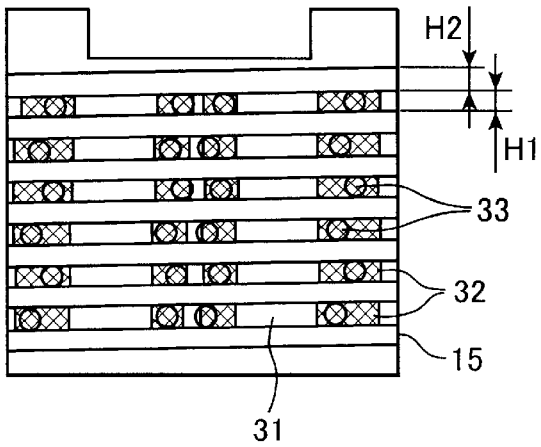

As shown in FIGS. 2 and 3, electrodes 33, 35 are formed on the front and rear surfaces 15*a*, 15*b* at positions corresponding to the through holes 36. The flexible printed cable 16 is connected to the electrode 35 by soldering.

Although not shown in the drawings, the piezoelectric element 31 is provided with a pair of side electrodes, one on a side of the piezoelectric element 31 for positive polarity and the other on opposite side for negative polarity. The electrode 33 is coated with the electrically conductive adhesive 32 for the continuity with the side electrodes of the piezoelectric element 31.

The electrodes 33, 35 are both plated with gold. It has been confirmed through an experiment that if the electrode 33 is not plated with gold, the contact resistance between the electrode 33 made from the tungsten and the electrically conductive adhesive 32 will be undesirably large. Plating the electrode 33 with gold solves this problem.

Also, plating the electrode 35 with gold well secures the solder joint between the flexible printed cable 16 and the electrode 35. In addition, a high-ink-resistant solder joint is provided.

Next, the method for providing the stationary plate 15 attached with the piezoelectric element 31 will be described. First, a green sheet, which will be the stationary plate 15, is prepared, and the plurality of through holes 36 are formed thereto. In the present embodiment, a diameter d2 of the through holes 36 is set to 0.2 mm. Then, tungsten is filled as the filler 34 in the through holes 36 and is also applied on the front and rear surfaces 15*a*, 15*b* over the through holes 36 for the electrodes 33, 35. The resultant product is subject to calcinations at a temperature of about 2000° C. Because the tungsten has a melting point of 3387° C., the tungsten will not be melted down during the calcinations at the temperature of about 2000° C. As a result, the stationary plate 15 with the electrodes 33, 35 formed thereon is provided (FIG. 3 (*a*)). In this embodiment, the stationary plate 15 has a thickness of 1 mm. A diameter d1 of the electrodes 33 is preferably 0.20 mm to 0.45 mm, and is set to 0.45 mm in this embodiment. Then, the surface of the electrodes 33 and 35 is plated with gold, and a pair of piezoelectric-element blocks 31*a* are placed and fixed by an epoxy adhesive (not shown) on the stationary plate 15 at predetermined positions and orientation as shown in FIG. 3(*b*).

Next, as shown in FIG. 3(*c*), the adhesive 32 are coated on the front surface 15*a* and on the electrodes 33, but not on the piezoelectric-element block 31*a*. Then, as shown in FIG. 3(*d*), the piezoelectric-element blocks 31*a* are cut into a plurality of piezoelectric elements 31 with dicing process. As shown, a dicing width is H2, and the resultant piezoelectric element 31 has a width of H1. In this embodiment, the dicing width H2=0.18 mm, and the element width H1=0.33 mm. Because the element width H1 is smaller than the diameter d1 of the electrode 33, the dicing process cuts away portions of the electrodes 33, resulting in oval-shaped electrodes 33. Finally, the electrode 35 is soldered with the flexible printed cable 16.

As described above, according to the present embodiment, the diameter d1 of the electrode 33 is set to 0.45 mm. This dimension of the electrode 33 is small enough for providing a sufficient adhering area between the adhesive 32 and the stationary plate 15, and is large enough for securing sufficient conductivity. That is, the adhering strength between the adhesive 32 and gold plated on the electrodes 33 is relatively weak, and so there is a danger that the adhesive 32 is peeled off the stationary plate 15 during the dicing process. However, because the adhesive 32 is securely adhered to the stationary plate 15 with relatively large area, the peelings will be avoided during the dicing process and even in the heat cycle. At the same time, the electrode 33 has the sufficient dimension to secure the conductivity between the adhesive 32.

Although the diameter d2 of the through holes 36 could be as large as 0.51 mm, within which the interference between the neighboring electrodes 33 would be theoretically prevented, the diameter d2 is set to equal to or less than the dicing width H1 (d2≦H1) in the present embodiment. This is because that if the diameter d2 is set greater than the dicing width H1, the dicing process will whittle a portion of the filler 34. This is a waste of the filler 34, and there is no reason for setting the diameter d2 greater than the dicing width H1.

As described above, because the tungsten is used as the filler 34 rather than the conventional silver paste, the filler 34 can be filled into the through holes 36 before the green sheet is subject to calcinations. Therefore, the sintering process for the tungsten is unnecessary after the calcinations. Accordingly, compared with the conventional process where the filler is sintered after the calcinations, the process of the present embodiment is simplified and economical.

Further, when the filler is sintered after the calcinations, the volume of the filler will be reduced at the time of sintering, resulting in air bubbles generated within the filler. Such air bubbles weaken the strength of the filler and causes breakage of the filler in the worse case. However, the calcinations for the stationary plate 15 and the sintering for the filler are performed at the same time, air bubbles will be not generated within the filler because the shrinkage percentage of the green sheet is larger than that of the filler. Accordingly, such problems can be avoided.

Because the individual electrodes 33 are formed on the stationary plate 15 before the dicing process, the adhesive 32 is not peeled off the electrode 33 during the dicing process, so the continuity can be well maintained. That is, if the tungsten plated with gold is first coated all over the front surface 15*a* and then cut into individual electrodes 33 by the dicing process as in the conventional manner, the conductive adhesive 32 would be easily peeled off the electrode 33. This results in undesirable electrical disconnection between the piezoelectric element and the front electrodes. However, the present embodiment prevents such problems.

Moreover, migration has not occurred with the tungsten electrodes 33, 35 even when the resultant product has been placed in high-temperature high-humidity environment. Accordingly, the continuity failure can be avoided, and the head 1 will less likely have continuity failure. This contrast to the conventional head with electrodes formed of silver.

Because electrode 35 is formed of tungsten plated with gold, the electrode 35 is easily soldered with the flexible printed cable 16 with a soldering temperature, which is nearly 30° C. lower than a soldering temperature for a conventional silver electrode. Also, the soldering strength between the gold-plated electrode 35 and the flexible printed cable 16 is sufficiently strong even under the heat cycle.

It is easier to form the through holes 36 as small as 0.2 mm before the calcinations compared with after the calcinations. This further improves integration of nozzles.

It should be noted that although the tungsten is used as the filler 34 in the above described embodiment, molybdenum-manganese alloy can be used instead. In this case also, the head 1 can be formed in the same manner, and the above effects can be obtained.

While some exemplary embodiments of this invention have been described in detail, those skilled in the art will recognize that there are many possible modifications and variations which may be made in these exemplary embodiments while yet retaining many of the novel features and advantages of the invention.

What is claimed is:

1. An ink jet print head comprising:

a stationary plate having a first surface and a second surface opposite to the first surface, a first electrode provided on the first surface; and a laminated piezoelectric element mounted on the first surface, the laminated piezoelectric element being electrically connected to the first electrode via an electrically conductive adhesive, wherein the first electrode is formed of one of tungsten and molybdenum-manganese alloy.

2. The ink jet print head according to claim 1, further comprising:

a second electrode provided on the second surface; and a flexible printed cable mounted on the second surface, the flexible printed cable being in electrical connection with the second electrode, wherein the second electrode is formed of one of tungsten and molybdenum-manganese alloy.

3. The ink jet print head according to claim 2, wherein the first electrode and the second electrode are both plated with gold.

4. The ink jet print head according to claim 2, wherein:

the stationary plate is formed with a through hole having first end opened at the first surface and a second end opened at the second surface, the through hole being filled with a filler that is electrically conductive, wherein the filler is one of tungsten and molybdenum-manganese alloy;

the first electrode is provided on the first end in electrical connection with the filler;

the second electrode is provided on the second end in electrical connection with the filler; and the stationary plate is a ceramic plate.

5. A producing method of producing an ink jet print head, comprising the steps of:

a) forming a plurality of through holes in a green sheet, the through holes having first ends opened to a first surface of the green sheet and second ends opened to a second surface of the green sheet;

b) filling in the through holes with filler, wherein the filler is one of tungsten and molybdenum-manganese alloy;

c) forming a plurality of first electrodes on the first ends from one of tungsten and molybdenum-manganese alloy;

d) forming a plurality of second electrodes on the second ends from one of tungsten and molybdenum-manganese alloy;

e) plating the first and second electrodes with gold;

f) placing a laminated-piezoelectric block on the first surface;

g) applying an electrically conductive adhesive over the first surface and the first electrodes; and h) dicing the laminated-piezoelectric block into a plurality of laminated piezoelectric elements.

6. The producing method according to claim 5, further comprising the steps of i) attaching a flexible printed cable to the corresponding second electrode by soldering.

7. The producing method according to claim 5, further comprising the steps of j) calcinating the green sheet after the step d).

* * * * *